US007614895B2

(12) United States Patent
Jur et al.

(10) Patent No.: US 7,614,895 B2
(45) Date of Patent: Nov. 10, 2009

(54) ELECTRICAL BUSWAY AND COUPLING ASSEMBLY THEREFOR

(75) Inventors: Arthur J. Jur, Greenwood, SC (US); Stephen W. Oneufer, Greenwood, SC (US); Phillip D. Miller, Greenwood, SC (US); Douglas V. Taylor, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/022,364

(22) Filed: Jan. 30, 2008

(65) Prior Publication Data

US 2009/0191739 A1 Jul. 30, 2009

(51) Int. Cl.
*H01R 13/648* (2006.01)

(52) U.S. Cl. ..... 439/213; 439/108

(58) Field of Classification Search ..... 439/213, 439/108

See application file for complete search history.

(56) References Cited

U.S. PATENT DOCUMENTS 3,287,487 A * 11/1966 Fehr, Jr. ..... 174/71 B
5,073,120 A * 12/1991 Lincoln et al. ..... 439/92
5,895,279 A 4/1999 Petrisko et al.

OTHER PUBLICATIONS

Lux Lighting Trunking Range, http://www.memonline.com/lux.html, Nov. 19, 2007, pp. 1-6.

* cited by examiner

*Primary Examiner*—Truc T Nguyen
(74) *Attorney, Agent, or Firm*—Martin J. Moran

(57) ABSTRACT

A coupling assembly is provided for an electrical busway having a first section and a second section. The coupling assembly includes at least one housing having first and second ends. A plurality of electrical conductors extend through such housing and electrically connect the first and second sections of the electrical busway. A plurality of electrical insulators surround at least some of the electrical conductors. A first coupling member couples the first end of the at least one housing to the first section of the electrical busway, and a second coupling member couples the second end of such housing to the second section of the electrical busway. The at least one housing and the electrical conductors extending therethrough are flexible, and the housing is electrically grounded. The coupling assembly electrically connects the first and second sections of the electrical busway, without a number of separate termination boxes.

16 Claims, 4 Drawing Sheets

ELECTRICAL BUSWAY AND COUPLING ASSEMBLY THEREFOR

BACKGROUND OF THE INVENTION

1. Field of the Invention

The invention relates generally to electrical conductors and, more particularly, to electrical busways. The invention also relates to coupling assemblies for electrical busways.

2. Background Information

Various electrical components are defined by, and subject to, regulatory requirements. For example and without limitation, the Underwriter's Laboratory (UL) defines an "electrical busway", at UL 857, as a grounded metal enclosure containing factory mounted conductors that are usually copper or aluminum bars, rods, or tubes. Similarly, the National Electric Code (NEC) defines an electrical busway as a grounded metal enclosure containing factory mounted, bare, or insulated conductors, which are usually copper or aluminum bars, rods, or tubes.

Typically, electrical busways include a plurality of electrical conductors (e.g., wires, cables or other suitable conductive members made from an electrically conductive material such as, for example and without limitation, copper or aluminum) that are insulated by a coating, film or sleeve of a non-conductive material (e.g., electrical insulator) and enclosed in a housing, such as an elongated rail structure. The electrical conductors of the electrical busway receive, for example, different phases of alternating current power that power electrical equipment that is electrically connected to the electrical busway.

Different sections of the electrical busway must be suitably electrically connected to bridge a conductive path between those sections. One prior proposal accomplishes this objective by bolting, welding or otherwise suitably electrically and mechanically connecting rigid bus bars between the electrical busway sections. The bus bars electrically interconnect the electrical conductors of one electrical busway section with the corresponding electrical conductors of another, different electrical busway section. However, the bus bars are rigid (e.g., inflexible) and must be permanently deformed to the desired configuration. This limits the number of possible positions in which the various sections of the electrical busway can be arranged and/or rearranged. It also results in the electrical busway occupying a relatively large amount of space, and is labor and cost-intensive.

In an attempt to address the foregoing disadvantages, one prior proposal provides a flexible busway assembly to electrically connect the rigid sections of the electrical busway. However, among other disadvantages, these flexible busway assemblies have termination boxes between the flexible portion and the fixed end portions that mate to the electrical busway sections. Such termination boxes are disadvantageously complex and bulky, thereby inhibiting the full range of flexibility of the flexible assembly. They also necessitate a plurality of separate and independent electrical terminations to effectuate the electrical connection between each electrical conductor and its corresponding terminal of the electrical busway. Specifically, at a minimum, a termination is required between the end of the electrical conductor and the first side of the termination box, and another separate and independent termination is required between the corresponding electrical terminal of the electrical busway and the second side of the termination box. The plurality of separate and independent terminations per electrical conductor are, therefore, independently made on separate discrete segments of the termination box. Each termination point is subject to stress (e.g., a stress concentration point) and, therefore, is susceptible to damage leading to an electrical fault or failure condition. The complex nature of the termination boxes also makes them labor and cost-intensive to manufacture.

Other prior proposals incorporate a flexible non-metallic bellows or housing enclosing the electrical conductors of the flexible busway assembly. However, these prior proposals are limited to applications that do not require a grounded (e.g., without limitation, metal) enclosure around the electrical conductors. Consequently, they are not considered to meet the aforementioned definition of an "electrical busway" and, therefore, are not suitable for certain applications. For example and without limitation, applications that are subject to National Electrical Manufacturers Association (NEMA) standards require the electrical conductors to be enclosed in a grounded metal enclosure, and the busway fittings must be able to carry electrical current up to about 6000 A. Flexible assemblies that do not have a grounded enclosure surrounding the electrical conductors do not satisfy these criteria.

There is, therefore, room for improvement in electrical busways and in coupling assemblies therefor.

SUMMARY OF THE INVENTION

These needs and others are met by embodiments of the invention, which are directed to a coupling assembly for electrically connecting various sections of an electrical busway together, wherein the coupling assembly meets the definition of an "electrical busway" under a number of applicable regulations (e.g., without limitation, National Electrical Code; UL 857), yet is also flexible so that the electrical busway can be relatively quickly and easily configured and/or reconfigured in a wide variety of different orientations.

As one aspect of the invention, a coupling assembly is provided for an electrical busway. The electrical busway includes a first section and a second section. The coupling assembly comprises: at least one housing including a first end and a second end; a plurality of electrical conductors extending through the at least one housing, the electrical conductors being structured to electrically connect the first section of the electrical busway to the second section of the electrical busway; a plurality of electrical insulators surrounding at least some of the electrical conductors; a first coupling member structured to couple the first end of the at least one housing to the first section of the electrical busway; and a second coupling member structured to couple the second end of the at least one housing to the second section of the electrical busway. The at least one housing and the electrical conductors extending through such housing are flexible, and such housing is electrically grounded.

The first section of the electrical busway may include a plurality of first electrical terminals, and the second section of the electrical busway may include a plurality of second electrical terminals. Each of the electrical conductors may include a first end, a second end, and an intermediate portion. Each of the electrical insulators may be disposed on the intermediate portion of a corresponding one of the electrical conductors. The first end of a corresponding one of the electrical conductors may be structured to be electrically connected to a corresponding one of the first electrical terminals of the first section of the electrical busway, and the second end of a corresponding one of the electrical conductors may be structured to be electrically connected to a corresponding one of the second electrical terminals of the second section of the electrical busway.

Each of the first coupling member and the second coupling member may comprise a first side including an aperture, and a second side, wherein the second side is structured to be coupled to a corresponding one of the first section of the electrical busway and the second section of the electrical busway. The first end of a corresponding one of the electrical conductors may extend through the aperture of the first side of the first coupling member toward the second side of the first coupling member, and the second end of a corresponding one of the electrical conductors may extend through the aperture of the first side of the second coupling member toward the second side of the second coupling member. The first coupling member may be structured to at least partially overlay the first electrical terminals, and the second coupling member may be structured to at least partially overlay the second electrical terminals.

The first coupling member may further comprise a first sleeve and the second coupling member may further comprise a second sleeve, wherein the first sleeve is structured to overlay a portion of the first coupling member and a portion of the first section of the electrical busway, and wherein the second sleeve is structured to overlay a portion of the second coupling member and a portion of the second section of the electrical busway. At least one of the first coupling member and the second coupling member may further comprise a sleeve assembly. The sleeve assembly may include a plurality of sets of opposing electrical contacts, wherein each of the electrical conductors is structured to be electrically connected to a corresponding one of the sets of opposing electrical contacts of the sleeve assembly, between the corresponding one of the sets of opposing electrical contacts of the sleeve assembly.

The coupling assembly may be structured to electrically connect the first section of the electrical busway to the second section of the electrical busway, without a number of separate termination boxes. The at least one housing may be a plurality of housings, wherein a first number of the electrical conductors extends through a first corresponding one of the plurality of housings, and wherein a second different number of the electrical conductors extends through a second different corresponding one of the plurality of housings. The first end of the first one of the plurality of housings and the first end of the second different one of the plurality of housings may be structured to be coupled to the first section of the electrical busway by the first coupling member, wherein the second end of the first one of the plurality of housings and the second end of the second different one of the plurality of housings are structured to be coupled to the second section of the electrical busway by the second coupling member.

As another aspect of the invention, an electrical busway comprises: a first section; a second section spaced apart from the first section; and a coupling assembly comprising: at least one housing including a first end and a second end, a plurality of electrical conductors extending through the at least one housing, the electrical conductors electrically connect the first section of the electrical busway to the second section of the electrical busway, a plurality of electrical insulators surrounding at least some of the electrical conductors, a first coupling member coupling the first end of the at least one housing to the first section of the electrical busway, and a second coupling member coupling the second end of the at least one housing to the second section of the electrical busway. The at least one housing and the electrical conductors extending through such housing are flexible, and such housing is electrically grounded.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
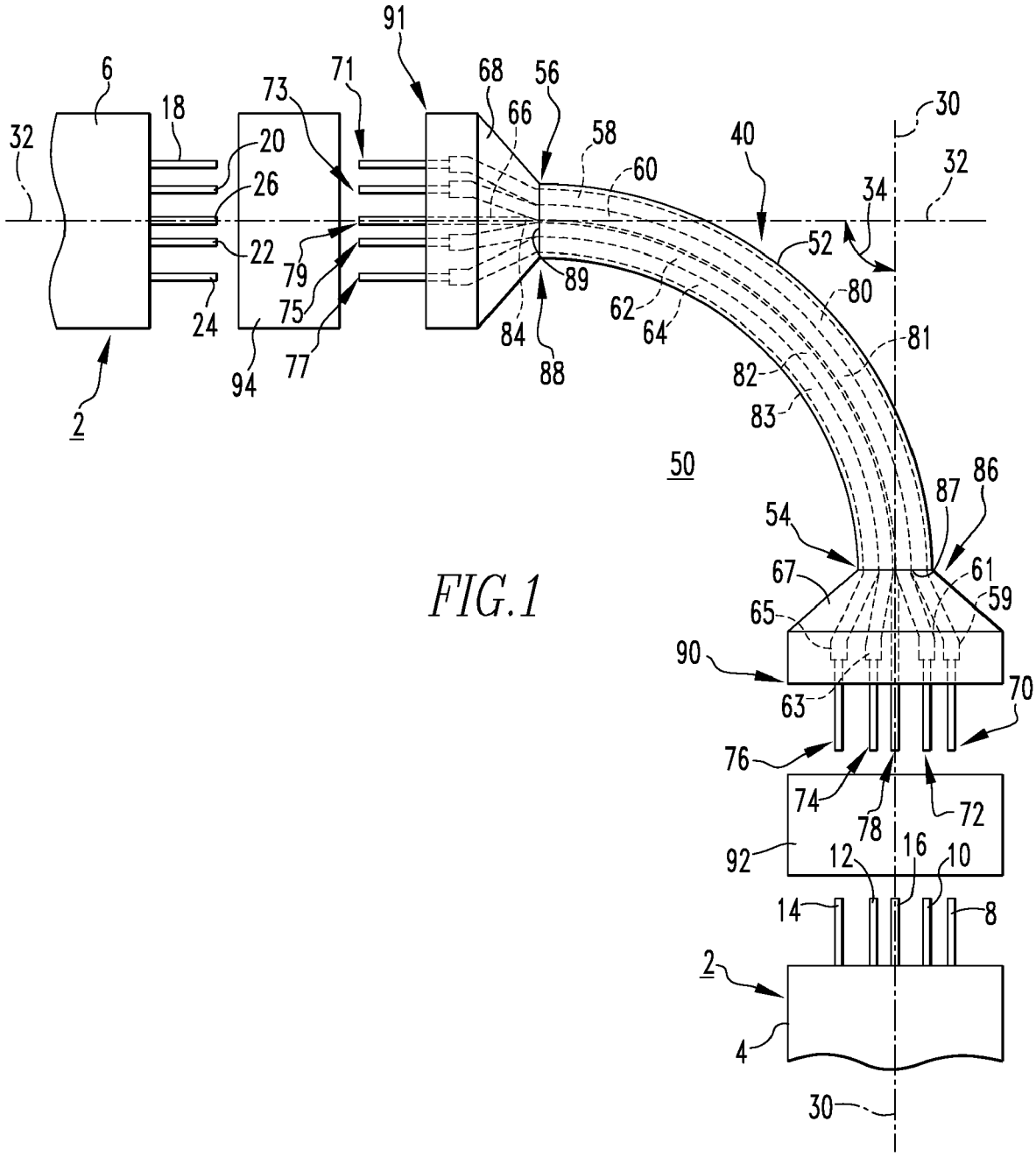
FIG. 1 is an exploded side elevation view of a coupling assembly and portions of an electrical busway, in accordance with an embodiment of the invention.

Directional phrases used herein, such as, for example, left, right, front, back, top, bottom and derivatives thereof, relate to the orientation of the elements shown in the drawings and are not limiting upon the claims unless expressly recited therein.

As employed herein, the term "electrical busway" refers to a grounded metal enclosure containing factory mounted conductors such as, for example and without limitation, copper or aluminum bars, rods, or tubes, as defined by a number of electrical regulations (e.g., without limitation, the Underwriter's Laboratory (UL); the National Electric Code (NEC); other suitable regulating entities).

As employed herein, the term "electrical conductor" means any known or suitable component expressly intended to conduct electrical current, which is also relatively flexible, and expressly includes, but is not limited to, electrical wires and electrical cables.

As employed herein, the term "bus bar" refers to a substantially rigid (e.g., inflexible) electrical conductor.

As employed herein, the term "electrical terminal" refers to a portion of the electrical busway to which a corresponding one of the electrical conductors is electrically connected.

As employed herein, the term "flexible" refers to the ability of a component to be positioned (e.g., without limitation, bent) and/or repositioned in a wide variety of different orientations, without being permanently deformed. For example and without limitation, the disclosed coupling assembly is flexible so that one end of the coupling assembly can be positioned at any suitable angle with respect to the opposite end of the coupling assembly, without permanently deforming the coupling assembly or its constituent parts.

As employed herein, the statement that two or more parts are "coupled" together shall mean that the parts are joined together either directly or joined through one or more intermediate parts.

As employed herein, the term "number" refers to the quantity one or an integer greater than one (i.e., a plurality).

FIG. 1 shows a coupling assembly 50 for an electrical busway 2, in accordance with one non-limiting embodiment of the invention. The electrical busway 2 includes first and second sections 4,6, which are spaced apart from, and disposed at an angle with respect to, each other. Specifically, the first section 4 has a first longitudinal axis 30, and the second section 6 has a second longitudinal axis 32. The aforementioned angle, 34, is formed between the axes 30,32, as shown. In the example of FIG. 1, the angle 34 is about 90 degrees. However, it will be appreciated that it may be any suitable alternative angle (not shown) between about 0 and about 180 degrees. Thus, it will be appreciated that the disclosed coupling assembly 50 is structured to provide a flexible electrical busway segment having at least one bend 40 (one is shown in FIG. 1).

Specifically, the coupling assembly 50 includes a housing 52 having first and second ends 54,56. A plurality of electrical conductors 58,60,62,64,66 (shown substantially in hidden line drawing in FIG. 1) extend through the housing 52 and electrically connect the first section 4 of the electrical busway 2 to the second section 6 of the electrical busway 2. Electrical insulators 59,61,63,65 surround at least some 58,60,62,64 of the electrical conductors 58,60,62,64,66. Specifically, in the example of FIGS. 1 and 2, one of the electrical conductors, 66, is a ground conductor that is not required to be covered by an electrical insulator. It will, however, be appreciated that any known or suitable alternative number, type and/or configuration of electrical conductors could be employed, without departing from the scope of the invention. It will also be appreciated that such electrical conductors could be respectively disposed within any suitable number and/or configuration of housings extending between the first and second sections 4,6 of the electrical busway 2. See, for example and without limitation, coupling assembly 150 discussed hereinbelow with respect to FIG. 3, which includes two housings 152,152'.

A first coupling member 67 couples the first end 54 of the housing 52 to the first section 4 of the electrical busway 2, and a second coupling member 68, which in the example of FIG. 1 is substantially similar to first coupling member 67, couples the second end 56 of the housing 52 to the second section 6 of the electrical busway 2. The housing of the example coupling assembly 50 is a flexible conduit 52 made from a suitable electrically conductive material such as, for example and without limitation, a suitable metal (e.g., without limitation, a wire mesh conduit; a flexible metal conduit; a metal strip helically wound conduit; a braided electrical flexible conduit). Accordingly, among other benefits, the disclosed coupling assembly 50 provides a flexible segment and connection mechanism that meets a number of applicable regulatory requirements (e.g., without limitation, UL; NEC) for qualifying as an "electrical busway." Specifically, although it may be electrically grounded in any suitable manner, the example coupling assembly 50 is electrically grounded by virtue of the fact that, when it is electrically connected to the electrical busway 2, a continuous electrically conductive pathway is present between the constituent components (e.g., without limitation, housing 52) of the coupling assembly 50, which are themselves electrically conductive (e.g., without limitation, metallic), and the grounded portions (e.g., exteriors) of the corresponding sections 4,6 of the electrical busway 2. It is also configurable in a substantially infinite number of positions, and does not require the undesirable bulky and complex termination boxes (not shown) used by some known flexible busway designs (not shown) to provide the electrical connections between sections (e.g., without limitation 4,6) of the electrical busway 2.

Figure 2:
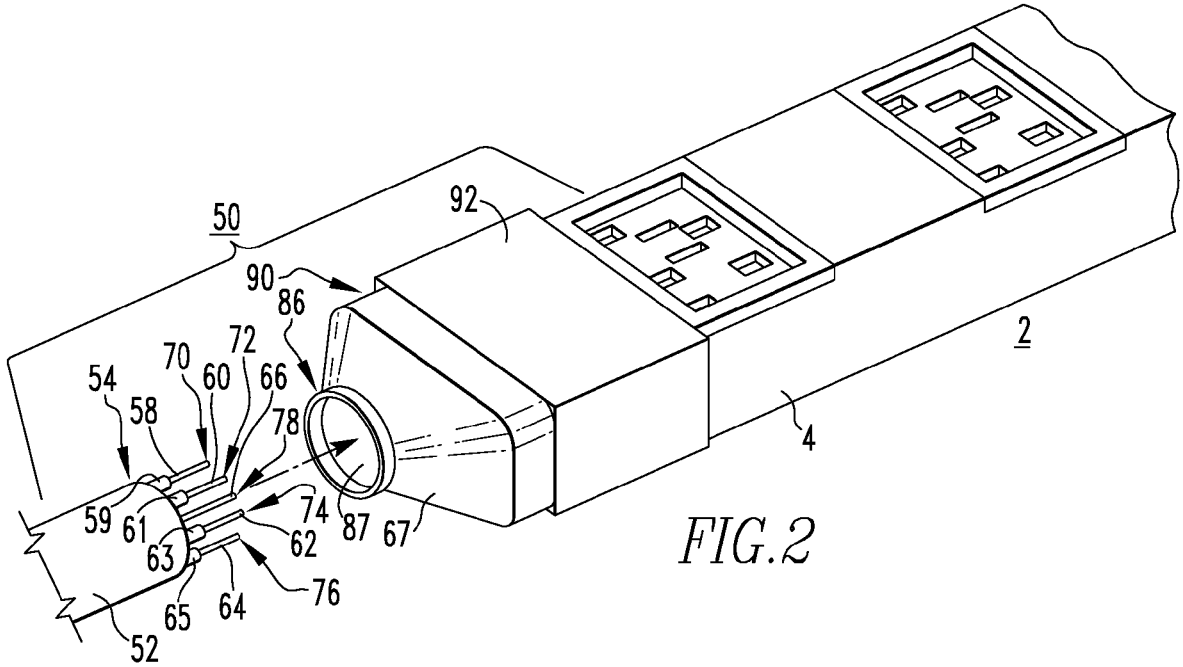
FIG. 2 is a partially exploded isometric view of the coupling assembly and a portion of the electrical busway of FIG. 1.

Continuing to refer to FIG. 1, and also to FIG. 2, the electrical connections between the electrical conductors 58,60,62,64,66 will now be described. Specifically, the example electrical conductors 58,60,62,64,66 are a plurality of electrical cables 58,60,62,64,66, including, three phase electrical cables 58,60,62, a neutral 64, and the ground 66. It will, however, be appreciated that any other known or suitable number and/or configuration of cables and/or associated power phases, could be employed. Each electrical cable 58,60,62,64,66 has a first end 70,72,74,76,78, a second end 71,73,75,77,79, and an intermediate portion 80,81,82,83,84, as shown in FIG. 1. The example electrical insulators are a plurality of electrically insulating sleeves 59,61,63,65, which are made from a suitable electrical insulating material (e.g., without limitation, rubber; epoxy resin) and which respectively cover the intermediate portions 80,81,82,83 of the corresponding electrical conductors 58,60,62,64.

The first section 4 of the example electrical busway 2 includes five first electrical terminals 8,10,12,14,16, and the second section 6 includes five second electrical terminals 18,20,22,24,26. The first ends 70,72,74,76,78 of the electrical conductors 58,60,62,64,66 are electrically connected to the first terminals 8,10,12,14,16, respectively, in a suitable manner. Likewise, the second ends 71,73,75,77,79 of the electrical conductors 58,60,62,64,66 are suitably electrically connected to the second electrical terminals 18,20,22,24,26, respectively. The electrical connections may be made, for example and without limitation, by brazing or otherwise suitably mechanically coupling and electrically connecting the electrical conductors 58,60,62,64,66 to their corresponding electrical terminals 8,10,12,14,16,18,20,22,24,26. For example and without limitation, they may be fixed in place either with a separate insulator (not shown), or molded into place with an insulating material (e.g., without limitation, epoxy resin), or held in place with a sleeve assembly 200 (see FIG. 4, discussed hereinbelow).

It will be appreciated that the electrical busway 2 could have any known or suitable alternative number and/or configuration of terminals (e.g., 8,10,12,14,16,18,20,22,24,26) other than that which is shown, without departing from the scope of the invention. It will also be appreciated that the coupling members 67,68 (both shown in FIG. 1; see also coupling members 167,168 of FIG. 3) of the disclosed coupling assembly 50 (see also coupling assembly 150 of FIG. 3) can be readily coupled to and removed from the corresponding section 4,6 of the electrical busway 2, in order to access the aforementioned electrical connections. Specifically, each of the coupling members 67,68 (both shown in FIG. 1) respectively includes a first side 86,88 having an aperture 87,89 (aperture 87 is best shown in FIG. 2), and a second side 90,91. As best shown in FIG. 2, the electrical conductors 58,60,62,64,66 and a portion (e.g., first end 54) of the housing 52 of the coupling assembly 50 extend through the aperture 87 on the first side 86 of the coupling member 67. The second side 90,91 is structured to be suitably coupled to the corresponding section 4,6, respectively, of the electrical busway 2. For example and without limitation, the second sides 90 and 91 of the example coupling assembly 50 are structured to slip over sections 4 and 6, respectively, of the electrical busway 2, in order to engage the same by way of a slip fit.

Although not required, the example coupling member 67 further includes an optional sleeve 92 (see also second sleeve 94 of second coupling member 68 of FIG. 1). The sleeve 92 overlays a portion of the first coupling member 67 and a portion of the first section 4 of the electrical busway 2, in order to at least partially overlay the mechanical coupling and the electrical connections between the coupling assembly 50 and electrical busway 2. It will be appreciated that the second sleeve 94 of FIG. 1 functions in substantially the same manner. Thus, the sleeves 92,94 (both shown in FIG. 1) serve to surround, protect and/or insulate the joint between sections 4,6, respectively, of the electrical busway 2 and the corresponding end 54,56 of the coupling assembly 50.

Figure 3:
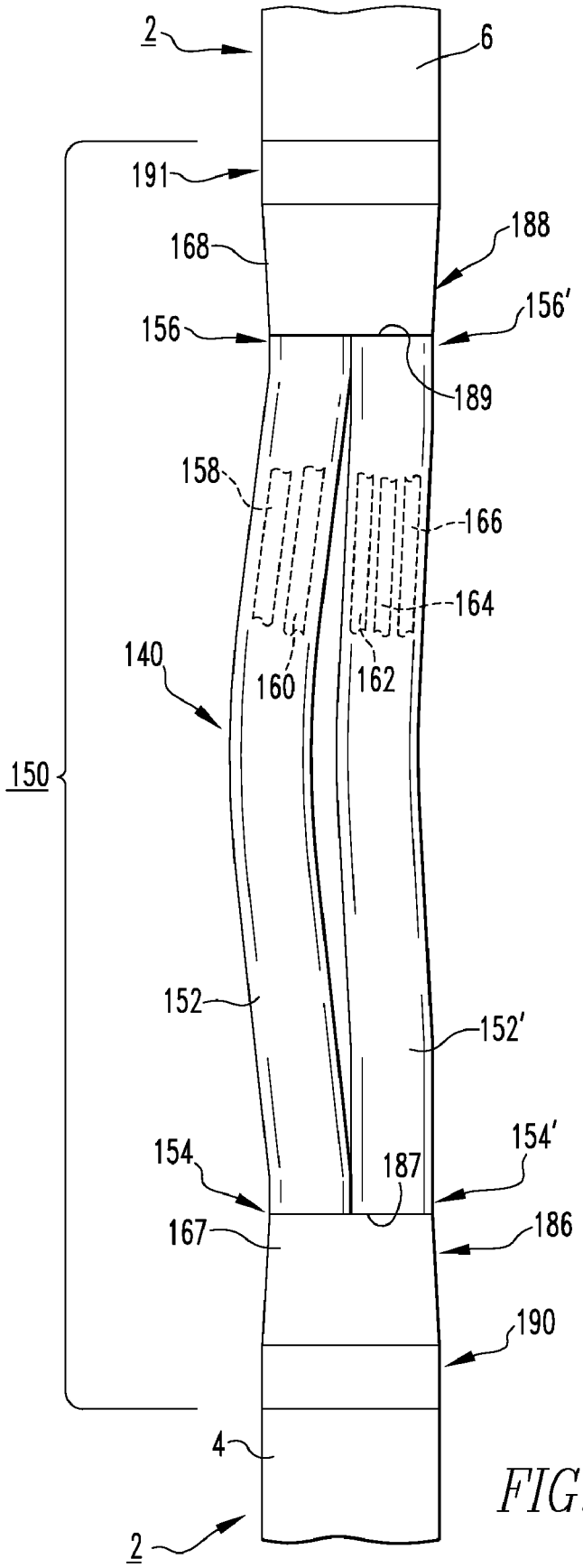
FIG. 3 is a side elevation view of a coupling assembly, in accordance with another embodiment of the invention.

In some applications, for example and without limitation, where electrical regulations (e.g., without limitation, UL; NEC; NEMA) require a particular number of electrical conductors and/or a specific current rating, more than one housing 152,152' can be employed, as shown, for example and without limitation, in FIG. 3. Specifically, the coupling assembly 150 of FIG. 3 has two housings 152,152', wherein a first number of electrical conductors 158,160 (partially shown in hidden line drawing in FIG. 3) extend through the first housing 152, and a second different number of electrical conductors 162,164,166 (partially shown in hidden line drawing in FIG. 3) extend through the other housing 152'. It will be appreciated that both housings 152,152' are flexible such that the coupling assembly 150 may include at least one bend (e.g., without limitation, bend 140 of housing 152) between the first and second sections 4,6 (partially shown in FIG. 3) of the electrical busway 2. In the example of FIG. 3, the first ends 154 and 154' of both housings 152 and 152', are respectively coupled to the first section 4 of the electrical busway 2 by single coupling member 167, and the second ends 156 and 156' of the housings 152 and 152', are respectively coupled to the second section 6 of the electrical busway 2 by single coupling member 168. It will, however, be appreciated that the coupling assembly (e.g., 150) could employ any known or suitable alternative number and/or configuration of housings (e.g., 152,152'), and that such housings (e.g., 152,152') could be coupled to the corresponding sections 4,6 of the electrical busway 2 using any suitable number and/or configuration of coupling members (e.g., 167,168), without departing from the scope of the invention.

Figure 4:
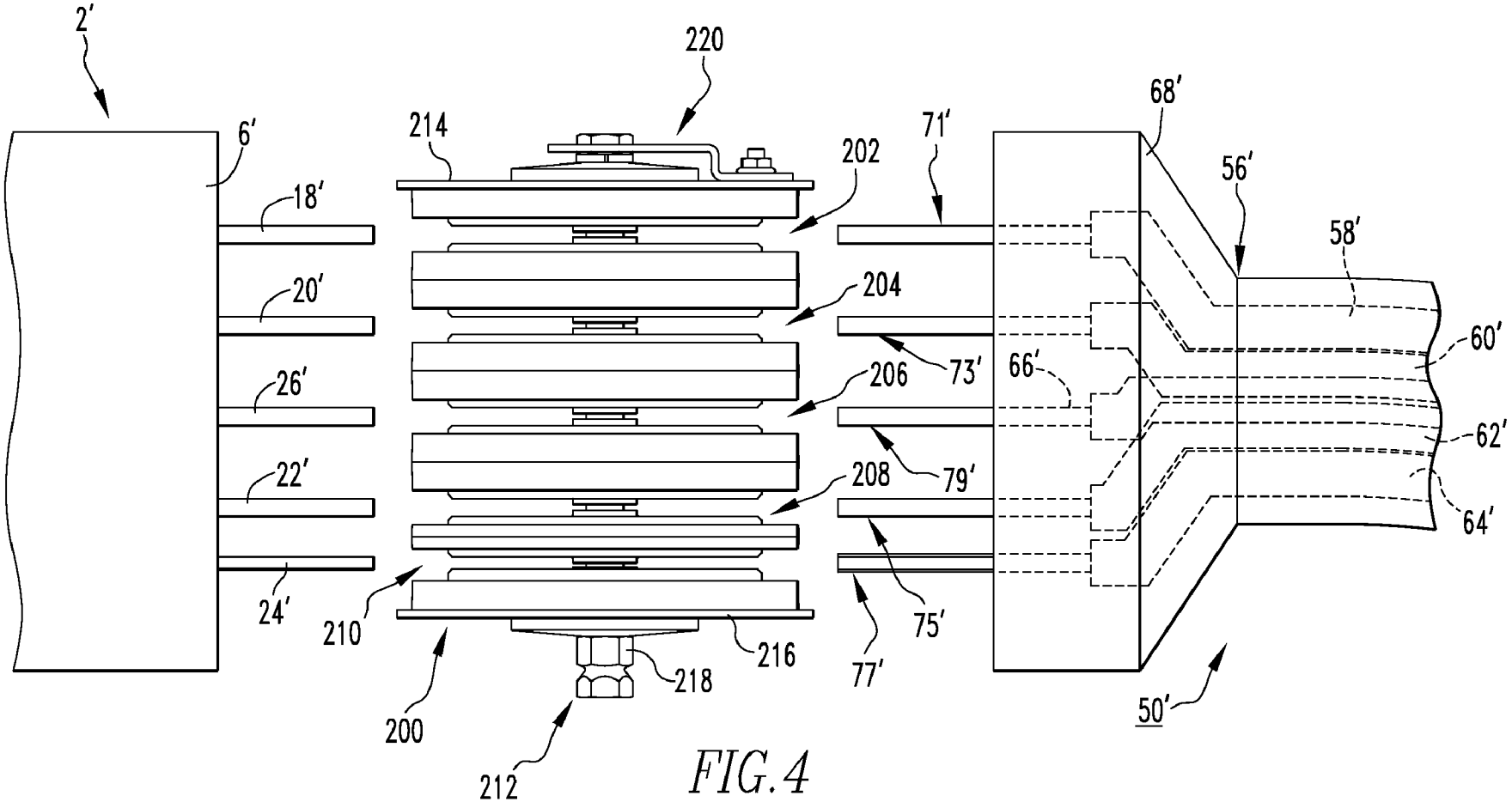
FIG. 4 is an exploded side elevation view of a coupling assembly and portion of an electrical busway, in accordance with another embodiment of the invention.

FIG. 4 shows one non-limiting example of the aforementioned sleeve assembly 200 for electrically connecting the second ends 71',73',75',77',79' of the electrical conductors 58',60',62',64',66', respectively, to the corresponding second terminals 18',20',22',24',26' of the electrical busway 2'. Specifically, in the example of FIG. 4, the sleeve assembly 200 includes sets of opposing electrical contacts 202,204,206,208,210, one for each electrical connection between the coupling assembly 50' and the corresponding electrical busyway section 6'. For simplicity of illustration and economy of disclosure, only one sleeve assembly 200 is shown and described. It will, however, be appreciated that, although not required, the opposite end (not shown) of the example coupling assembly 50' employs a substantially identical sleeve assembly (not shown).

The sets of opposing electrical contacts 202,204,206,208,210 are held in place by a fastener mechanism 212 and are disposed between end plates 214,216. The example fastener mechanism 212 includes a fastener 218 that extends through the end plates 214,216 and sets opposing electrical contacts 202,204,206,208,210, and can be suitably adjusted (e.g., loosened; tightened) to establish the desired spacing between the individual electrical contacts (not numbered) of the sets of opposing electrical contacts 202,204,206,208,210. In this manner, the ends 71',73',75',77',79' of the electrical conductors 58',60',62',64',66', respectively, can be electrically connected and mechanically secured to its corresponding electrical busway terminal 18',20',22',24',26'. In other words, the electrical connection is sandwiched between and maintained by the corresponding set of opposing electrical contacts 202,204,206,208,210 of the sleeve assembly 200. The example sleeve assembly 200 is suitably electrically grounded generally indicated by reference character 220 of FIG. 4. FIG. 4 represents merely one illustrative example in accordance with one non-limiting embodiment of the invention. It will be appreciated that, as previously discussed, the electrical connections between the electrical conductors (e.g., 58',60',62',64',66') of the coupling assembly (e.g., 50') and the electrical busway (e.g., 2') may be made using any known or suitable alternative mechanism, process or assembly.

Accordingly, the disclosed coupling assemblies 50,150 provide flexible electrical busway sections that allow the installer of the electrical busway system to configure the electrical busway 2 to a variety of specifications, without the need of rigid welded bus bars, without permanent deformation (e.g., without limitation, bending) of the electrical conductors 58,60,62,64,66, and without requiring separate termination boxes to transition the direction of the electrical busway 2. The coupling assemblies 50,150 also satisfy a number of regulatory standards (e.g., without limitation, UL; NEC) to qualify as "electrical busways," and meet also NEMA standards that require the electrical conductors 58,60,62,64,66 to be enclosed in a grounded metal enclosure (e.g., housing 52,152,152').

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A coupling assembly for an electrical busway, said electrical busway including a first section and a second section, said coupling assembly comprising:

at least one housing including a first end and a second end;

a plurality of electrical conductors extending through said at least one housing, said electrical conductors being structured to electrically connect the first section of said electrical busway to the second section of said electrical busway;

a plurality of electrical insulators surrounding at least some of said electrical conductors;

a first coupling member structured to couple the first end of said at least one housing to the first section of said electrical busway; and a second coupling member structured to couple the second end of said at least one housing to the second section of said electrical busway, wherein said at least one housing and said electrical conductors extending through said at least one housing are flexible, wherein said at least one housing is at least one flexible electrically conductive conduit, and wherein said at least one flexible electrically conductive conduit is electrically grounded.

2. The coupling assembly of claim 1 wherein the first section of said electrical busway includes a plurality of first electrical terminals; wherein the second section of said electrical busway includes a plurality of second electrical terminals; wherein each of said electrical conductors includes a first end, a second end, and an intermediate portion; wherein each of said electrical insulators is disposed on the intermediate portion of a corresponding one of said electrical conductors;

wherein the first end of a corresponding one of said electrical conductors is structured to be electrically connected to a corresponding one of said first electrical terminals of the first section of said electrical busway; and wherein the second end of a corresponding one of said electrical conductors is structured to be electrically connected to a corresponding one of said second electrical terminals of the second section of said electrical busway.

3. The coupling assembly of claim 2 wherein said plurality of electrical conductors is a plurality of electrical cables; wherein said plurality of electrical insulators is a plurality of electrically insulating sleeves; and wherein a corresponding one of said electrically insulating sleeves surrounds the intermediate portion of a corresponding one of said electrical conductors.

4. The coupling assembly of claim 2 wherein each of said first coupling member and said second coupling member comprises a first side including an aperture and a second side; wherein the second side is structured to be coupled to a corresponding one of the first section of said electrical busway and the second section of said electrical busway; wherein the first end of a corresponding one of said electrical conductors extends through said aperture of the first side of said first coupling member toward the second side of said first coupling member; wherein the second end of a corresponding one of said electrical conductors extends through said aperture of the first side of said second coupling member toward the second side of said second coupling member; wherein said first coupling member is structured to at least partially overlay said first electrical terminals; and wherein said second coupling member is structured to at least partially overlay said second electrical terminals.

5. The coupling assembly of claim 4 wherein said first coupling member further comprises a first sleeve; wherein said second coupling member further comprises a second sleeve; wherein said first sleeve is structured to overlay a portion of said first coupling member and a portion of the first section of said electrical busway; and wherein said second sleeve is structured to overlay a portion of said second coupling member and a portion of the second section of said electrical busway.

6. The coupling assembly of claim 1 wherein said coupling assembly is structured to electrically connect the first section of said electrical busway to the second section of said electrical busway, without a number of separate termination boxes.

7. The coupling assembly of claim 1 wherein said coupling assembly is structured to include at least one bend between the first section of said electrical busway and the second section of said electrical busway.

8. The coupling assembly of claim 1 wherein said plurality of electrical conductors includes a ground conductor; and wherein said ground conductor is not surrounded by one of said electrical insulators.

9. An electrical busway comprising:

a first section;

a second section spaced apart from said first section; and a coupling assembly comprising:

at least one housing including a first end and a second end, a plurality of electrical conductors extending through said at least one housing, said electrical conductors electrically connect the first section of said electrical busway to the second section of said electrical busway, a plurality of electrical insulators surrounding at least some of said electrical conductors, a first coupling member coupling the first end of said at least one housing to the first section of said electrical busway, and a second coupling member coupling the second end of said at least one housing to the second section of said electrical busway, wherein said at least one housing and said electrical conductors extending through said at least one housing are flexible, wherein said at least one housing is at least one flexible electrically conductive conduit, and wherein said at least one flexible electrically conductive conduit is electrically grounded.

10. The electrical busway of claim 9 wherein the first section of said electrical busway includes a plurality of first electrical terminals; wherein the second section of said electrical busway includes a plurality of second electrical terminals; wherein each of said electrical conductors includes a first end, a second end, and an intermediate portion; wherein each of said electrical insulators is disposed on the intermediate portion of a corresponding one of said electrical conductors; wherein the first end of a corresponding one of said electrical conductors is electrically connected to a corresponding one of said first electrical terminals of the first section of said electrical busway; and wherein the second end of a corresponding one of said electrical conductors is electrically connected to a corresponding one of said second electrical terminals of the second section of said electrical busway.

11. The electrical busway of claim 10 wherein said plurality of electrical conductors is a plurality of electrical cables; wherein said plurality of electrical insulators is a plurality of electrically insulating sleeves; and wherein a corresponding one of said electrically insulating sleeves surrounds the intermediate portion of a corresponding one of said electrical conductors.

12. The electrical busway of claim 10 wherein each of said first coupling member and said second coupling member comprises a first side including an aperture and a second side; wherein the second side is coupled to a corresponding one of the first section of said electrical busway and the second section of said electrical busway; wherein the first end of a corresponding one of said electrical conductors extends through said aperture of the first side of said first coupling member toward the second side of said first coupling member; wherein the second end of a corresponding one of said electrical conductors extends through said aperture of the first side of said second coupling member toward the second side of said second coupling member; wherein said first coupling member at least partially overlays said first electrical terminals; and wherein said second coupling member at least partially overlays said second electrical terminals.

13. The electrical busway of claim 12 wherein said first coupling member further comprises a first sleeve; wherein said second coupling member further comprises a second sleeve; wherein said first sleeve overlays a portion of said first coupling member and a portion of the first section of said electrical busway; and wherein said second sleeve overlays a portion of said second coupling member and a portion of the second section of said electrical busway.

14. The electrical busway of claim 9 wherein the first section of said electrical busway has a first longitudinal axis; wherein said second section of said electrical busway has a second longitudinal axis; wherein said first longitudinal axis is disposed at an angle with respect to said second longitudinal axis, in order that said coupling assembly includes at least one bend between the first section of said electrical busway and the second section of said electrical busway; and wherein said angle is between about 0 and about 180 degrees.

15. The electrical busway of claim 10 wherein said coupling assembly electrically connects the first section of said electrical busway to the second section of said electrical busway, without a number of separate termination boxes.

16. The electrical busway of claim 10 wherein said plurality of electrical conductors includes a ground conductor; and wherein said ground conductor is not surrounded by one of said electrical insulators.

* * * * *